US009078322B2

(12) United States Patent
Lin

(10) Patent No.: US 9,078,322 B2
(45) Date of Patent: Jul. 7, 2015

(54) METHOD OF DRIVING LED CHIPS OF DIFFERENT SPECIFICATIONS

(71) Applicants: HEP TECH CO., LTD., Taichung (TW); Ming-Feng Lin, Taichung (TW)

(72) Inventor: Ming-Feng Lin, Taichung (TW)

(73) Assignees: HEP TECH CO., LTD., Taichung (TW); Ming-Feng Lin, Taichung (TW)

( * ) Notice: Subject to any disclaimer, the term of this patent is extended or adjusted under 35 U.S.C. 154(b) by 0 days.

(21) Appl. No.: 14/205,014

(22) Filed: Mar. 11, 2014

(65) Prior Publication Data

US 2014/0292230 A1 Oct. 2, 2014

(30) Foreign Application Priority Data

Mar. 27, 2013 (TW) ..... 102110957 A

(51) Int. Cl.
*H05B 37/02* (2006.01)
*H05B 33/08* (2006.01)

(52) U.S. Cl.
CPC ..... *H05B 33/0842* (2013.01)

(58) Field of Classification Search
CPC ..... H05B 33/0809; H05B 33/0833; H05B 37/02; H05B 39/02; H05B 39/04
USPC ..... 315/185 R, 186, 187, 192, 224, 291, 315/307, 308
See application file for complete search history.

(56) References Cited

U.S. PATENT DOCUMENTS

| | | | | |
|---|---|---|---|---|
| 6,586,890 | B2 * | 7/2003 | Min et al. | 315/224 |
| 2005/0231133 | A1 * | 10/2005 | Lys | 315/291 |
| 2011/0062872 | A1 * | 3/2011 | Jin et al. | 315/122 |
| 2012/0306389 | A1 * | 12/2012 | Shteynberg et al. | 315/186 |

* cited by examiner

*Primary Examiner* — Tung X Le
(74) *Attorney, Agent, or Firm* — WPAT, PC; Justin King

(57) ABSTRACT

A method of driving LED chips, wherein the LED chips have different specifications, includes the steps of: A. defining a plurality of setting currents; B. connecting a LED chip; C. selecting one of the setting currents which matches a rated current of the LED chip; and D. providing power with the selected setting current to the LED chip. Whereby, the method could be applied to drive LED chips of several different specifications.

7 Claims, 5 Drawing Sheets

METHOD OF DRIVING LED CHIPS OF DIFFERENT SPECIFICATIONS

The current application claims a foreign priority to the patent application of Taiwan No. 102110957 filed on Mar. 27, 2013.

BACKGROUND OF THE INVENTION

1. Technical Field

The present invention relates generally to driving LED, and more particularly to a method of driving LED chips of different specifications.

2. Description of Related Art

Typically, a LED illuminating device includes a LED chip and a driving apparatus, wherein the driving apparatus provides power to drive the LED chip. There are various types of LED chips in the current market, and LED chips of different specifications may individually have different rated voltages and rated currents. Conventionally, a driving apparatus merely fits one specific specification, and therefore could drive only one type of LED chips. Thus, since there are many types of LED chips having different specifications, the inventory pressure of driving apparatuses is high. And given that manufacturers have to produce driving apparatuses to drive each type of LED chips, the quantities of each type of driving apparatuses is limited, and therefore the price and the manufacturing cost is hardly lowered. If a method of driving LED chips of different specifications can be provided, the inventory pressure and the manufacturing cost of driving apparatuses will be effectively reduced.

BRIEF SUMMARY OF THE INVENTION

In view of the above, the primary objective of the present invention is to provide a method of driving LED chips, wherein the LED chips have different specifications.

The present invention provides a method of supplying a method of driving LED chips, wherein the LED chips have different specifications, which include the steps of: A. defining a plurality of setting currents; B. connecting a LED chip; C. selecting one of the setting currents which matches a rated current of the LED chip; and D. providing power with the selected setting current to the LED chip.

Whereby, the method of driving LED chips could be applied to drive LED chips of different specifications, which effectively improves the inconvenience of the conventional driving apparatus that it could be only compatible with LED chips of one specific specification.

BRIEF DESCRIPTION OF THE SEVERAL VIEWS OF THE DRAWINGS

The present invention will be best understood by referring to the following detailed description of some illustrative embodiments in conjunction with the accompanying drawings, in which.

DETAILED DESCRIPTION OF THE INVENTION

Figure 1:
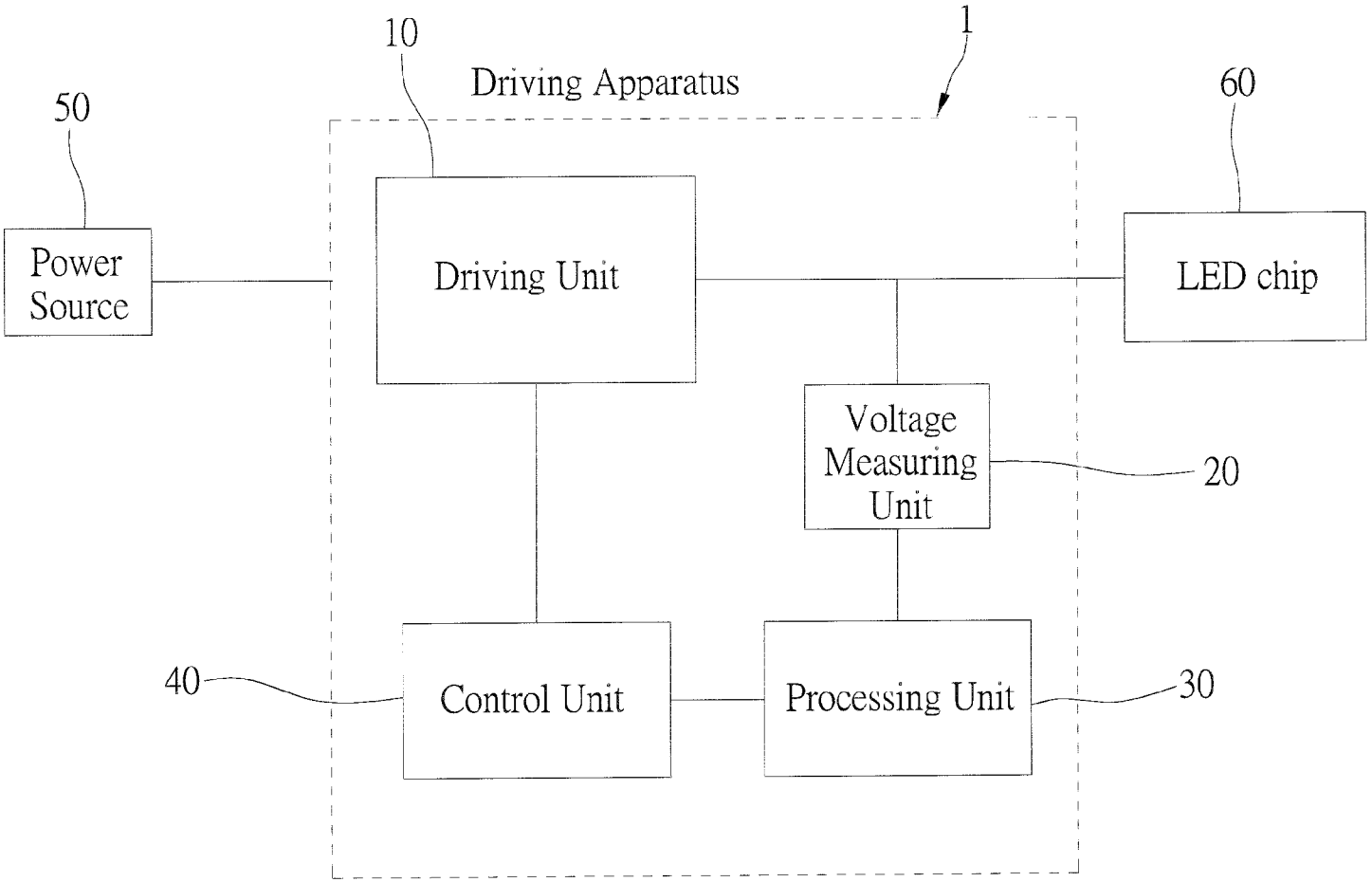
FIG. 1 is a block diagram of the driving apparatus of a first preferred embodiment of the present invention.

A driving apparatus 1 for driving LED (light emitting diode) chips of different specifications of a first embodiment of the present invention is shown in FIG. 1, which includes a driving unit 10, a voltage measuring unit 20, a processing unit 30, and a control unit 40.

The driving unit 10 electrically connects a power source 50 to a LED chip 60, wherein the driving unit 10 receives power from the power source 50, and outputs a driving voltage and a driving current to the LED chip 60. The driving unit 10 is controllable to change the driving voltage and the driving current. In practice, the design of the driving unit 10 could be based on PWM, half-bridge, buck, or boost circuits.

The voltage measuring unit 20 is electrically connected to the driving unit 10 to measure the driving voltage outputted to the LED chip 60 from the driving unit 10. The processing unit 30 is electrically connected to the voltage measuring unit 20, and the processing unit 30 is electrically connected to the driving unit 10 through the control unit 40. In the first preferred embodiment, the processing unit 30 has a memory.

Whereby, the aforementioned driving apparatus 1 could be used to apply a method of driving LED chips of different specifications. Here are 5 LED chips with different specifications for explanation purpose, which respectively have a rated voltage and a rated current of 45V/500 mA, 38V/700 mA, 34V/900 mA, 20V/1500 mA, and 14V/1400 mA, and any one of said LED chips could be connected to the driving unit 10 to be the LED chip 60.

Before performing the method, a voltage of each said LED chips is measured first while they are operating with a testing current, wherein the testing current is lower than rated currents of all the LED chips, and the testing current is a constant current. It may get a voltage when said LED chip is operating with the testing current, and this voltage is defined as a reference voltage, and the reference voltages of said LED chips are different from each other.

Figure 2:
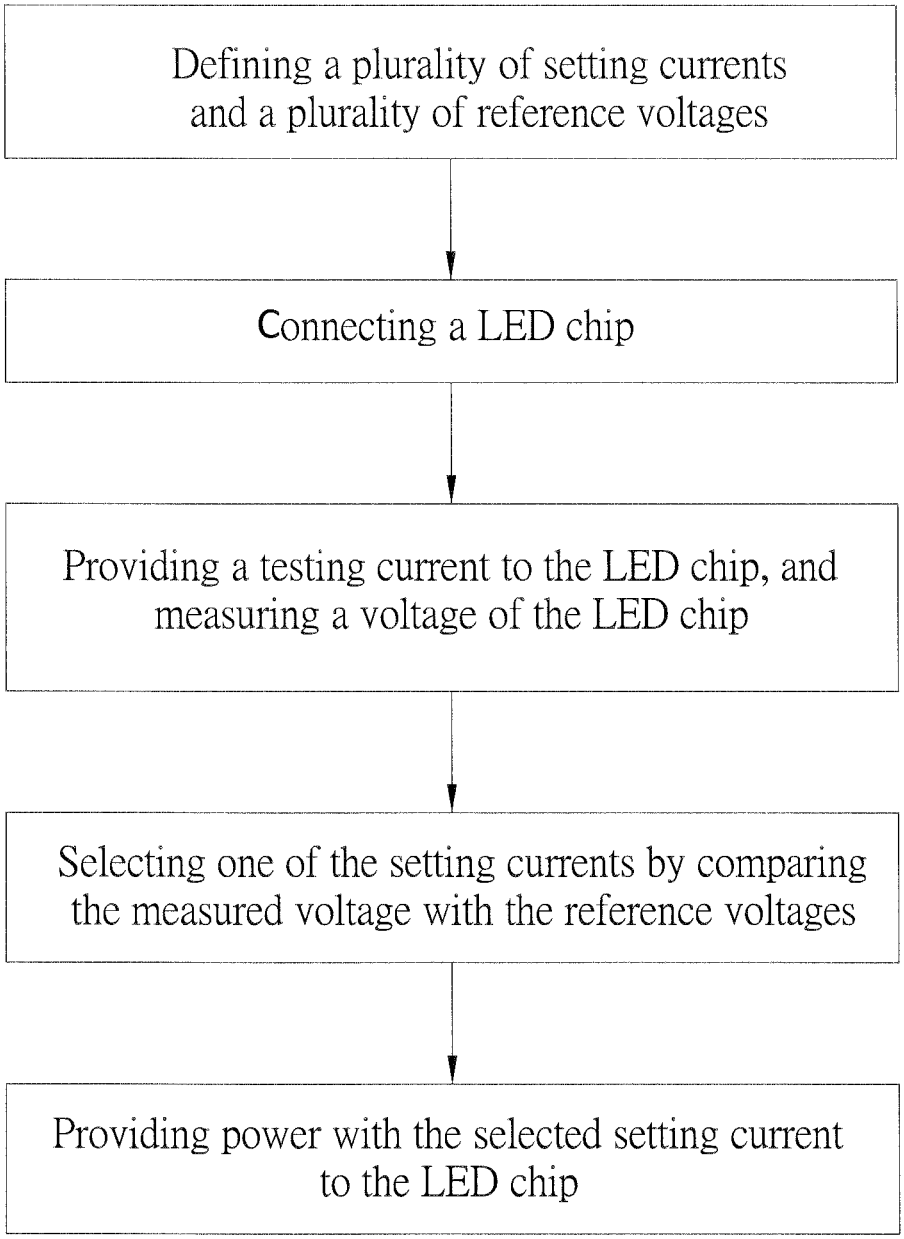
FIG. 2 is a flow chart of the first preferred embodiment of the present invention.

As shown in FIG. 2, the method of driving the LED chips includes the following steps:

A. Create a database in the memory of the processing unit 30 in advance, in which the reference voltages and current parameters of said LED chips are stored, wherein each reference voltage relates to one of the current parameters. With one of the current parameters, the processing unit 30 controls the control unit 40 to transmit a current control signal to the driving unit 10 accordingly. The driving current outputted by the driving unit 10 could be maintained as a specific setting current in this way. Whereby, a plurality of different setting currents could be defined in the driving apparatus 1 in advance, and each setting current corresponds to one of the reference voltage. The setting currents match the rated currents of said LED chips.

B. Connect a LED chip 60, which is one of said five LED chips as described above, to the driving unit 10.

C. Select one of the setting currents in the database, and the selected setting current matches the rated current of the LED chip 60. In the first preferred embodiment, the processing unit 30 transmits the current control signal through the control unit 40 to control the driving unit 10 to output the driving current as the testing current to the LED chip 60, and the processing unit 30 measures a voltage through the voltage measuring unit 20 at the same time. After that, the measured voltage is compared to the reference voltages in the database to determine which reference voltage matches the measured voltage. The current parameter which relates to the matched reference voltage is then obtained, and therefore the corresponding setting current is selected.

Figure 3:
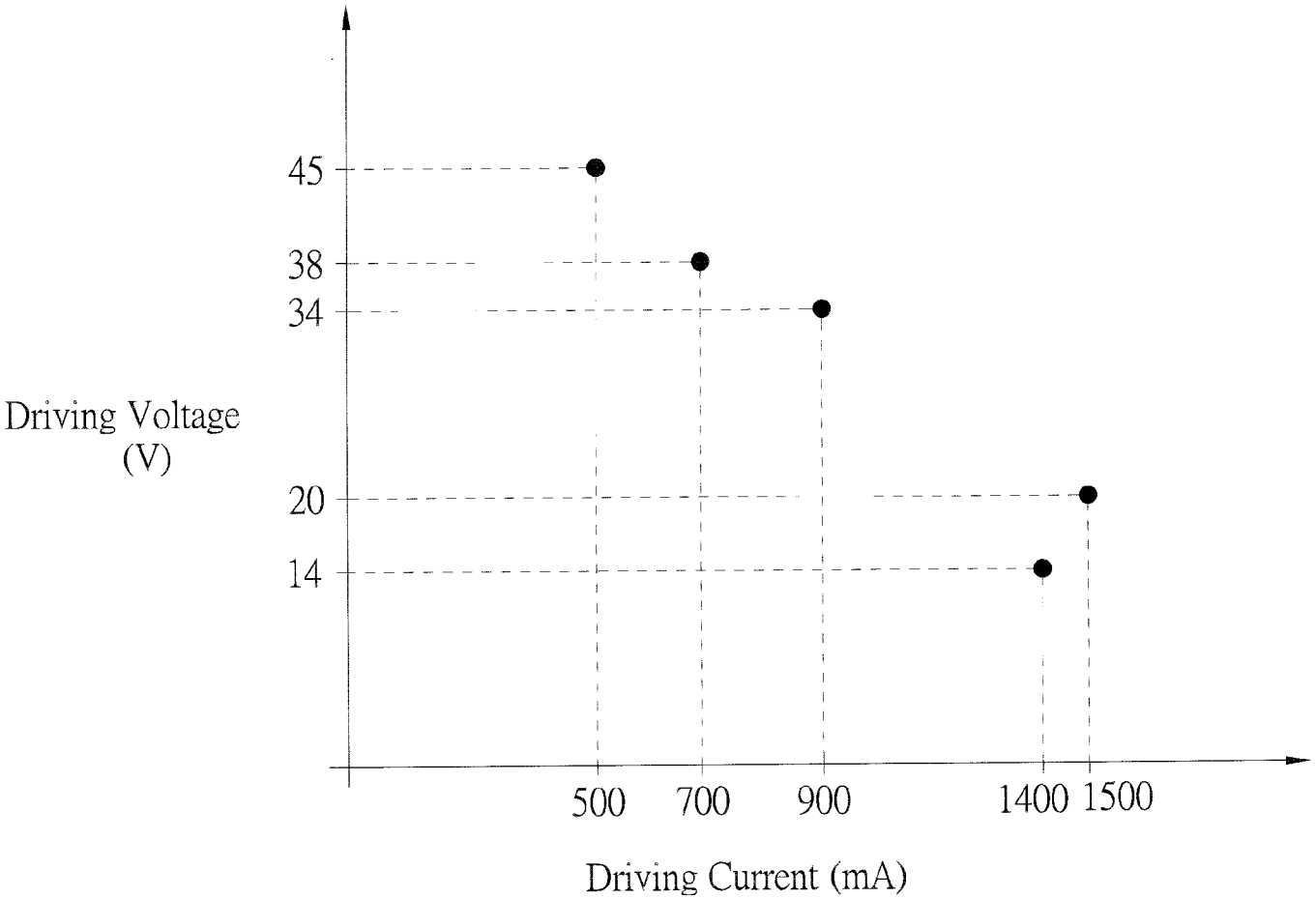
FIG. 3 is a diagram, showing the output characteristics of the first preferred embodiment of the present invention.

D. The processing unit 30 controls the control unit 40 according to the current parameter obtained in the step C to transmit the corresponding current control signal to the driving unit 10, and the driving unit 10 maintains the driving current as the selected setting current according to the current control signal. Whereby, the LED chip 60 is powered with its rated current. The driving unit 10 regulates the driving voltage automatically depending on the electronic properties of the LED chip 60, and therefore the power provided to the LED chip 60 could successfully fit its specification. As shown in FIG. 3, the driving apparatus 1 is able to provide the driving current and the driving voltage which fit the specification of each said LED chips.

With the aforementioned method, when the LED chip 60 is connected to the driving apparatus 1, the rated current of the LED chip 60 could be automatically detected, and therefore the driving apparatus 1 could provide the power which meets the requirement of the LED chip 60. In other words, the driving apparatus 1 could deal with LED chips of different specifications.

In the aforementioned embodiment, each setting current corresponds to a reference voltage, and in order to further compatible with even more types of LED chips, each setting current corresponds to a reference voltage segment in a second preferred embodiment of the present invention.

Figure 4:
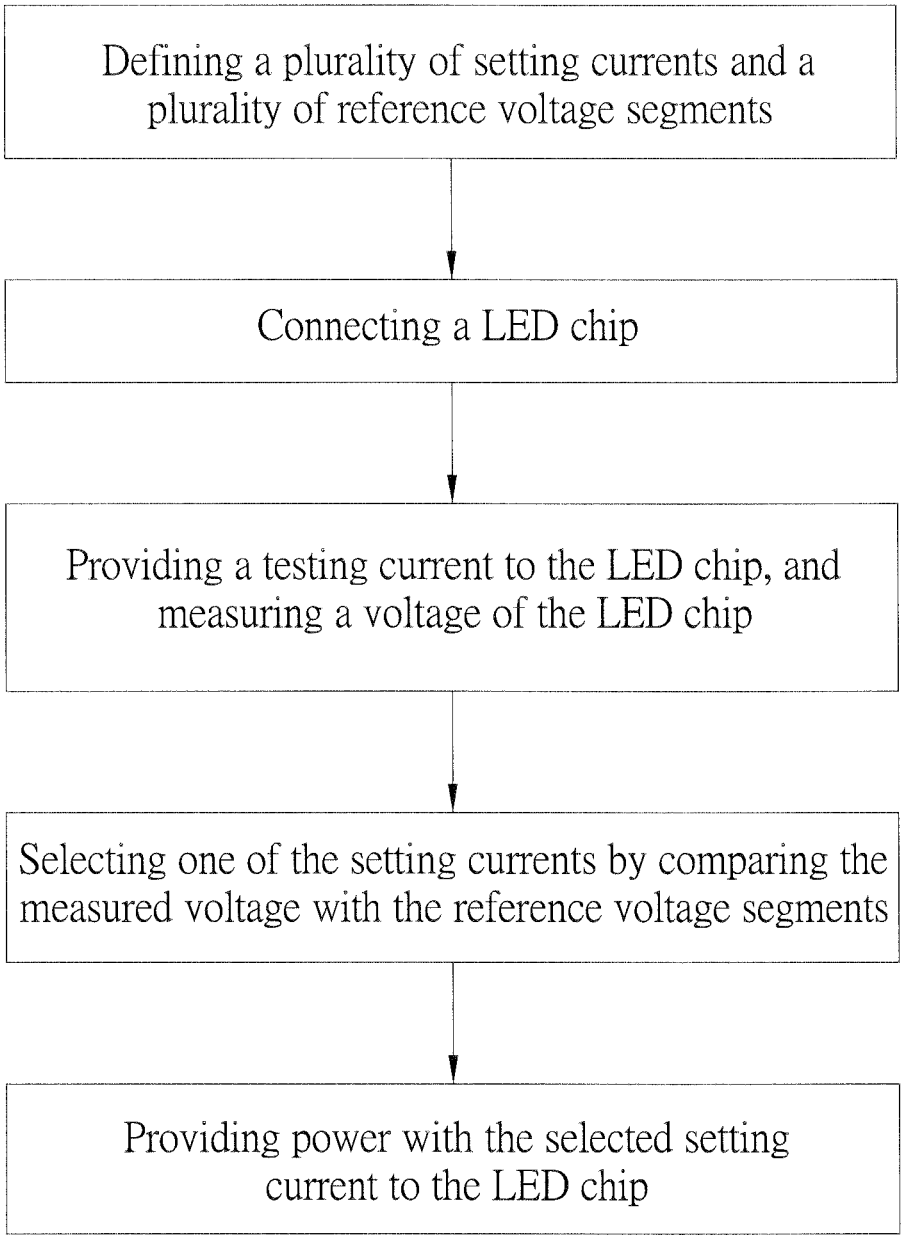
FIG. 4 is a flow chart of a second preferred embodiment of the present invention.

The flow chart of the second preferred embodiment of the present invention shown in FIG. 4 has roughly the same steps with the first embodiment, and the differences are described as followings.

In the step A, a plurality of reference voltage segments and a plurality of current parameters are defined in the database in advance, wherein each reference voltage segment relates to one of the current parameters. Whereby, the driving apparatus 1 has a plurality of different setting currents, and each setting current corresponds to one of the reference voltage segments.

In the step C, the driving unit 10 is controlled to output the testing current to the LED chip 60, and the voltage of the LED chip 60 is measured at the same time. When the measured voltage falls in one of the reference voltage segments, the current parameter which relates to that reference voltage segment is obtained from the database, and therefore the corresponding setting current is then selected.

After that, the driving unit 10 is controlled to output the driving current as the selected setting current, which equals the rated current of the LED chip 60. The driving unit 10 automatically regulates the driving voltage depending on the electronic properties of the LED chip 60, and therefore the power provided to the LED chip 60 could successfully fit its specification.

Figure 5:
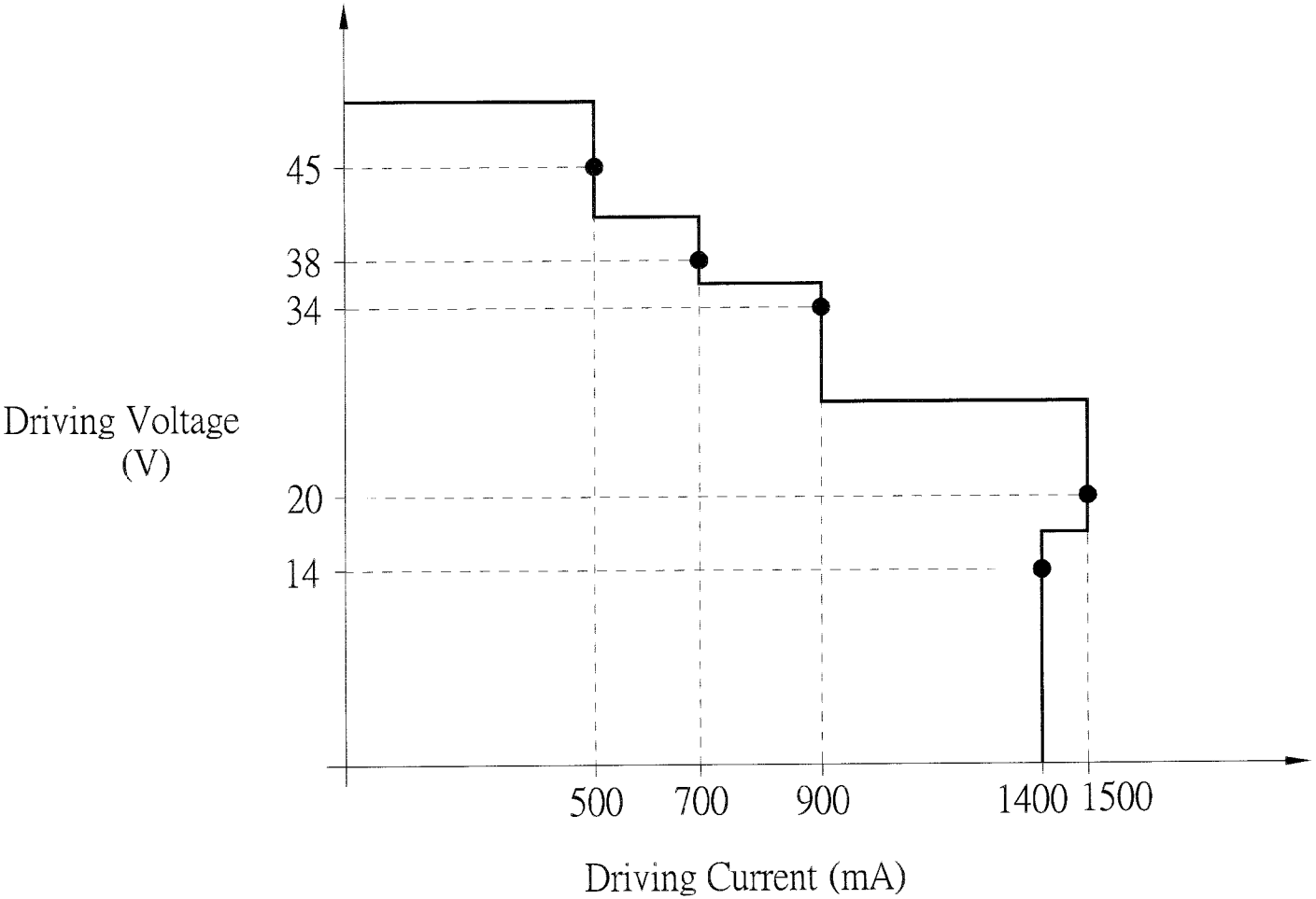
FIG. 5 is a diagram, showing the output characteristics of the second preferred embodiment of the present invention.

In the second preferred embodiment, an output curve of the driving apparatus 1 is shown in FIG. 5. For any LED chip, as long as its rated current matches the five currents in FIG. 5 while its rated voltage falls in the corresponding reference voltage segment, such LED chip could be powered by the driving apparatus 1. Therefore, the driving apparatus 1 could be applied to drive more types of LED chips, not just the 5 LED chips provided in the first embodiment.

Besides, in the second preferred embodiment, zero voltage is included in one of the reference voltage segments in the database. In other words, even if the driving voltage is measured as zero in the step C, there is still a corresponding setting current. Whereby, once the LED chip 60 is short, the driving current could be effectively restricted from damaging the driving unit 10.

In another embodiment, the control unit 40 transmits a voltage restriction signal to the driving unit 10 when the driving voltage measured by the voltage measuring unit 20 is higher than an upper limit voltage in the step D. After the driving unit 10 receives the voltage restriction signal, the driving voltage outputted to the LED chip 60 is maintained as the upper limit voltage. Whereby, the driving voltage outputted to the driving unit 10 wouldn't be too high to damage the LED chip 60 or the driving unit 10.

In the aforementioned first and second embodiments, the reference voltages, the current parameters, and the reference voltage segments in the database are stored in the memory of the processing unit 30 in the step A. In practice, the processing unit 30 could be a comparator circuit too. In such case, the reference voltage or reference voltage segment which corresponds to the driving voltage is determined by the comparator circuit in the step C. The comparator circuit outputs the corresponding voltage to the control unit, and the control unit transmits the corresponding current control signal to the driving unit 10 according to the received voltage. As a result, the corresponding setting current is selected.

With the method of driving the LED chips provided in the present invention, the driving apparatus 1 is able to drive the LED chips of different specifications, and is not limited for any specific one type of the LED chips. As a result, the inconvenience of the conventional driving apparatus, i.e., it could only drive the LED chip of one specific specification, is effectively improved.

It must be pointed out that the embodiments described above are only some preferred embodiments of the present invention. All equivalent structures and methods which employ the concepts disclosed in this specification and the appended claims should fall within the scope of the present invention.

What is claimed is:

1. A method of driving LED chips, wherein the LED chips have different specifications, comprising the steps of:

(a) defining a plurality of setting currents;

(b) connecting a LED chip;

(c) selecting one of the setting currents which matches a rated current of the LED chip;

(d) providing power with the selected setting current to the LED chip;

wherein each setting current relates to a reference voltage;

the step of selecting one of the setting currents includes providing the LED chip with a testing current, which is a constant current, measuring a voltage of the LED chip while the LED chip is operating with the testing current, and selecting one of the setting currents according to the reference voltage which matches the measured voltage.

2. The method of claim 1, wherein the testing current is lower than any one of the setting currents.

3. The method of claim 1, further comprising the step of maintaining a voltage of the power provided to the LED chip as an upper limit voltage when the voltage of the power is measured higher than the upper limit voltage in the step (d).

4. A method of driving LED chips, wherein the LED chips have different specifications, comprising the steps of:

(a) defining a plurality of setting currents;

(b) connecting a LED chip;

(c) selecting one of the setting currents which matches a rated current of the LED chip; and (d) providing power with the selected setting current to the LED chip;

wherein each setting current relates to a reference voltage segment;

the step of selecting one of the setting currents includes providing the LED with a testing current, which is a constant current, measuring a voltage of the LED chip while the LED chip is operating with the testing current, and selecting one of the setting currents according to the reference voltage segment in which the measured voltage falls.

5. The method of claim 4, wherein the testing current is lower than any one of the setting currents.

6. The method of claim 4, wherein zero voltage is included in one of the reference voltage segments.

7. The method of claim 4, further comprising the step of maintaining a voltage of the power provided to the LED chip as an upper limit voltage when the voltage of the power is measured higher than the upper limit voltage in the step (d).

* * * * *